US010533526B2

(12) United States Patent
Yamaguchi

(10) Patent No.: US 10,533,526 B2
(45) Date of Patent: Jan. 14, 2020

(54) CONNECTION STRUCTURE OF INTAKE PIPE

(71) Applicant: TOYOTA BOSHOKU KABUSHIKI KAISHA, Aichi (JP)

(72) Inventor: Takuma Yamaguchi, Aichi (JP)

(73) Assignee: TOYOTA BOSHOKU KABUSHIKI KAISHA, Aichi (JP)

( * ) Notice: Subject to any disclaimer, the term of this patent is extended or adjusted under 35 U.S.C. 154(b) by 0 days.

(21) Appl. No.: 16/208,063

(22) Filed: Dec. 3, 2018

(65) Prior Publication Data

US 2019/0186444 A1 Jun. 20, 2019

(30) Foreign Application Priority Data

Dec. 14, 2017 (JP) ..... 2017-240030

(51) Int. Cl.
*F02M 35/10* (2006.01)

(52) U.S. Cl.
CPC .....
*F02M 35/10144* (2013.01); *F02M 35/10321* (2013.01)

(58) Field of Classification Search
CPC ..... F02M 35/10144; F02M 35/10321; F16L 25/02; F16L 23/02; F16L 17/06; F16L 17/00; F01B 3/0017
USPC ..... 123/184.45, 184.52
See application file for complete search history.

(56) References Cited

U.S. PATENT DOCUMENTS 6,634,333 B2 * 10/2003 Fujieda ..... F02B 17/005 123/295
6,705,280 B1 * 3/2004 Lippert ..... F02B 23/104 123/306
6,874,465 B2 * 4/2005 Arimatsu ..... F02B 31/04 123/188.14
7,900,595 B2 * 3/2011 Abe ..... F02B 31/06 123/306
8,118,007 B2 * 2/2012 Sano ..... F02B 31/06 123/184.55
8,215,278 B2 * 7/2012 Kummermehr ..... F02B 25/14 123/184.52
8,733,318 B2 * 5/2014 Hoche ..... F02B 31/08 123/184.21
10,174,727 B2 * 1/2019 Chu ..... F02M 35/10255
10,197,013 B2 * 2/2019 Yoneyama ..... F02B 25/02
10,393,075 B2 * 8/2019 Kato ..... F02M 35/10255
10,400,720 B2 * 9/2019 Kato ..... F02M 35/10262
2004/0118379 A1 * 6/2004 Harui ..... F02B 31/04 123/432

(Continued)

FOREIGN PATENT DOCUMENTS

JP 2017-150366 8/2017

*Primary Examiner* — Hung Q Nguyen
*Assistant Examiner* — Brian P Monahon
(74) *Attorney, Agent, or Firm* — Greenblum & Berstein, P.L.C.

(57) ABSTRACT

The present connection structure of an intake pipe is a connection structure of an intake pipe for an engine head. The connection structure includes a partition wall member partitioning an intake passage along its axial direction and being inserted into the engine head, and an elastic gasket having a frame shape provided between the engine head and the intake pipe to seal therebetween. The intake pipe is provided at its connection end portion with an elastic body that presses the partition wall member in its insertion direction.

8 Claims, 6 Drawing Sheets

(56) References Cited

U.S. PATENT DOCUMENTS

| | | | | |
|---|---|---|---|---|
| 2004/0226535 | A1* | 11/2004 | Sakai | F02B 23/08 123/308 |
| 2004/0226536 | A1* | 11/2004 | Sakai | F02B 23/08 123/308 |
| 2005/0073062 | A1* | 4/2005 | Zwimpfer | F02M 7/12 261/65 |
| 2005/0081821 | A1* | 4/2005 | Katou | F02B 31/08 123/308 |
| 2005/0081822 | A1* | 4/2005 | Yageta | B22C 9/10 123/308 |
| 2005/0082028 | A1* | 4/2005 | Akaba | B22C 9/10 164/98 |
| 2006/0219202 | A1* | 10/2006 | Abe | F02B 31/06 123/184.56 |
| 2006/0231067 | A1* | 10/2006 | Masuta | B22C 9/10 123/308 |
| 2008/0035091 | A1* | 2/2008 | Geyer | F02B 25/22 123/184.52 |
| 2009/0314242 | A1* | 12/2009 | Ishihara | F02D 9/1035 123/184.56 |
| 2010/0288247 | A1* | 11/2010 | Tanikawa | F02M 35/10039 123/568.11 |
| 2012/0152216 | A1* | 6/2012 | Grether | F02B 25/20 123/65 P |
| 2012/0152218 | A1* | 6/2012 | Grether | F02M 13/04 123/73 R |

* cited by examiner

CONNECTION STRUCTURE OF INTAKE PIPE

CROSS REFERENCE TO RELATED APPLICATION

The present application claims priority under 35 U.S.C. § 119 of Japanese Application No. 2017-240030 filed on Dec. 14, 2017, the disclosure of which is expressly incorporated by reference herein in its entirety.

BACKGROUND OF THE INVENTION

(1) Field of the Invention

The present invention relates to a connection structure of an intake pipe, and more particularly to a connection structure of an intake pipe for an engine head.

(2) Description of Related Art

As a conventional connection structure of an intake pipe, a connection structure of an intake pipe for an engine head is generally known (e.g., refer to JP 2017-150366 A). JP 2017-150366 A discloses a technique of holding a partition wall member between an engine head and an intake pipe, wherein the partition wall member for partitioning an intake passage along its axial direction is inserted into the engine head, and the partition wall member includes a metal partition wall plate for partitioning the intake passage, resin insertion portions provided on both sides across the metal partition wall plate, and the insertion portion is inserted into a recessed portion formed in an inside wall of the intake passage of the engine head from the axial direction of the intake passage (refer to the paragraph [0015] of JP 2017-150366 A). According to this technique, when a valve in the intake pipe reduces an opening degree of one intake passage partitioned by the partition wall member, a tumble flow for improving fuel economy or the like is generated in a combustion chamber of the engine.

Unfortunately, the technique disclosed in JP 2017-150366 A causes the partition wall member to be held between the engine head and the intake pipe by insertion into the engine head without using rigid fastening with a bolt or the like, so that the partition wall member (particularly, the resin insertion portion) slides against the engine head due to pulsation of the engine. This causes the partition wall member to be abraded, so that there is a concern that abrasion powder of the partition wall member may adversely affect combustion.

SUMMARY OF THE INVENTION

Embodiments of the present invention are made in light of the above-mentioned circumstances, and it is an object thereof is to provide a connection structure of an intake pipe that can suppress sliding of a partition wall member against an engine head due to engine pulsation.

One aspect of the present embodiments provides a connection structure of an intake pipe for an engine head, comprising: a partition wall member partitioning an intake passage along its axial direction and being inserted into the engine head; and an elastic gasket having a frame shape provided between the engine head and the intake pipe to seal therebetween, wherein the intake pipe is provided at its connection end portion with an elastic body that presses the partition wall member in its insertion direction.

In a further aspect, the elastic body may be integrally formed inside the elastic gasket.

In a further aspect, the intake pipe may be provided at its connection end portion with a cutout portion recessed in an axial direction of the intake pipe, and the cutout portion may be provided in its inside wall with a stepped portion supporting a portion of the elastic body on its insertion side to be inserted into the cutout portion.

In a further aspect, the elastic body may be formed in an elongated shape in plan view, and the stepped portion may include a central stepped portion supporting a central portion of the elastic body in its elongated direction, and an end stepped portion supporting an end portion of the elastic body in its elongated direction.

In a further aspect, the elastic body may include: a main body inserted into the cutout portion and supported by the stepped portion; a pressing portion protruding from an end face of the main body, facing the engine head, to press the partition wall member; and a contact portion extending from the main body in its insertion direction to the cutout portion to be brought into contact with a side surface of the stepped portion.

In a further aspect, the contact portion may include a contact plate that is brought into contact with a side surface of the stepped portion, and a pair of pillars provided on both sides of the contact plate to hold the stepped portion laterally.

In a further aspect, the partition wall member may include a partition wall plate partitioning the intake passage, and insertion portions that are provided on both sides of the partition wall plate, and that are inserted into respective recessed portions formed in an inside wall of the intake passage of the engine head from an axial direction of the intake passage, and the elastic body may be provided so as to press the insertion portion in its insertion direction.

The connection structure of the intake pipe of the present embodiment includes a partition wall member partitioning the intake passage along its axial direction and being inserted into an engine head, and an elastic gasket having a frame shape provided between the engine head and the intake pipe to seal therebetween. The intake pipe is provided at its connection end portion with an elastic body that presses the partition wall member in its insertion direction. Accordingly, the elastic body presses the partition wall member in the insertion direction, so that sliding of the partition wall member against the engine head due to pulsation of the engine is suppressed.

When the elastic body is integrally formed inside the elastic gasket, the elastic body and the elastic gasket can be easily handled as an integrated body.

When the intake pipe is provided at its connection end portion with a cutout portion that is provided in its inside wall with a stepped portion supporting a portion of the elastic body on its insertion side to be inserted into the cutout portion, supporting by the stepped portion restricts displacement of the portion of the elastic body on its insertion side into the cutout portion. This enables not only a support structure of the elastic body to be set using the cutout portion, but also the cutout portion to prevent the intake pipe from increasing in thickness to suppress defective molding and increase in cycle time.

When the elastic body is formed in an elongated shape in plan view, and the stepped portion includes a central stepped portion and an end stepped portion, the central stepped portion supports a central portion of the elastic body in its elongated direction and the end stepped portion supports an end portion of the elastic body in its elongated direction.

This allows the step portion to stably support the elastic body even when the elastic body deteriorates over time. As a result, the elastic body can effectively press the partition wall member for a long period.

In addition, when the elastic body includes a main body, a pressing portion, and a contact portion, the pressing portion presses the partition wall member in its insertion direction with the contact portion being in contact with a side surface of the stepped portion supporting the main body. This allows the step portion to stably support the elastic body even when the elastic body deteriorates over time. As a result, the elastic body can effectively press the partition wall member for a long period.

When the contact portion includes a contact plate and a pair of pillars, the elastic body can more effectively press the partition wall member.

When the partition wall member includes a partition wall plate and an insertion portion, and the elastic body is provided so as to press the insertion portion in the insertion direction, the elastic body presses the insertion portion of the partition wall member in the insertion direction to suppress sliding of the partition wall member against the engine head due to pulsation of the engine.

BRIEF DESCRIPTION OF THE DRAWINGS

The present invention is further described in the detailed description which follows, in reference to the noted plurality of drawings by way of non-limiting examples of exemplary embodiments of the present invention, in which like reference numerals represent similar parts throughout the several views of the drawings, and wherein.

DETAILED DESCRIPTION OF PREFERRED EMBODIMENTS

The particulars shown herein are by way of example and for purposes of illustrative discussion of the embodiments of the present invention only and are presented in the cause of providing what is believed to be the most useful and readily understood description of the principles and conceptual aspects of the present invention. In this regard, no attempt is made to show structural details of the present invention in more detail than is necessary for the fundamental understanding of the present invention, the description is taken with the drawings making apparent to those skilled in the art how the forms of the present invention may be embodied in practice.

Figure 1:
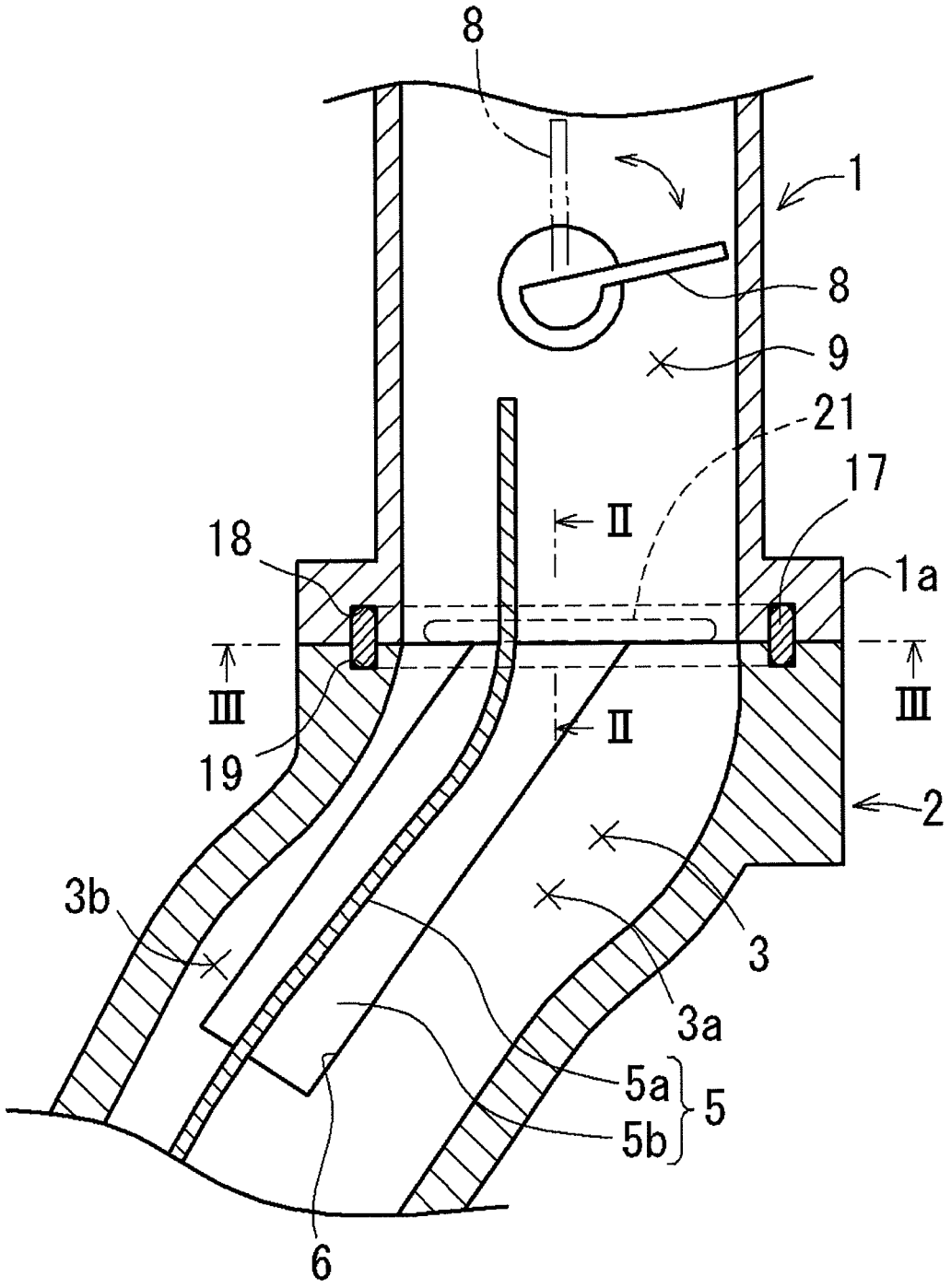
FIG. 1 is a longitudinal sectional view of a connection structure of an intake pipe according to an embodiment.
Figure 2:
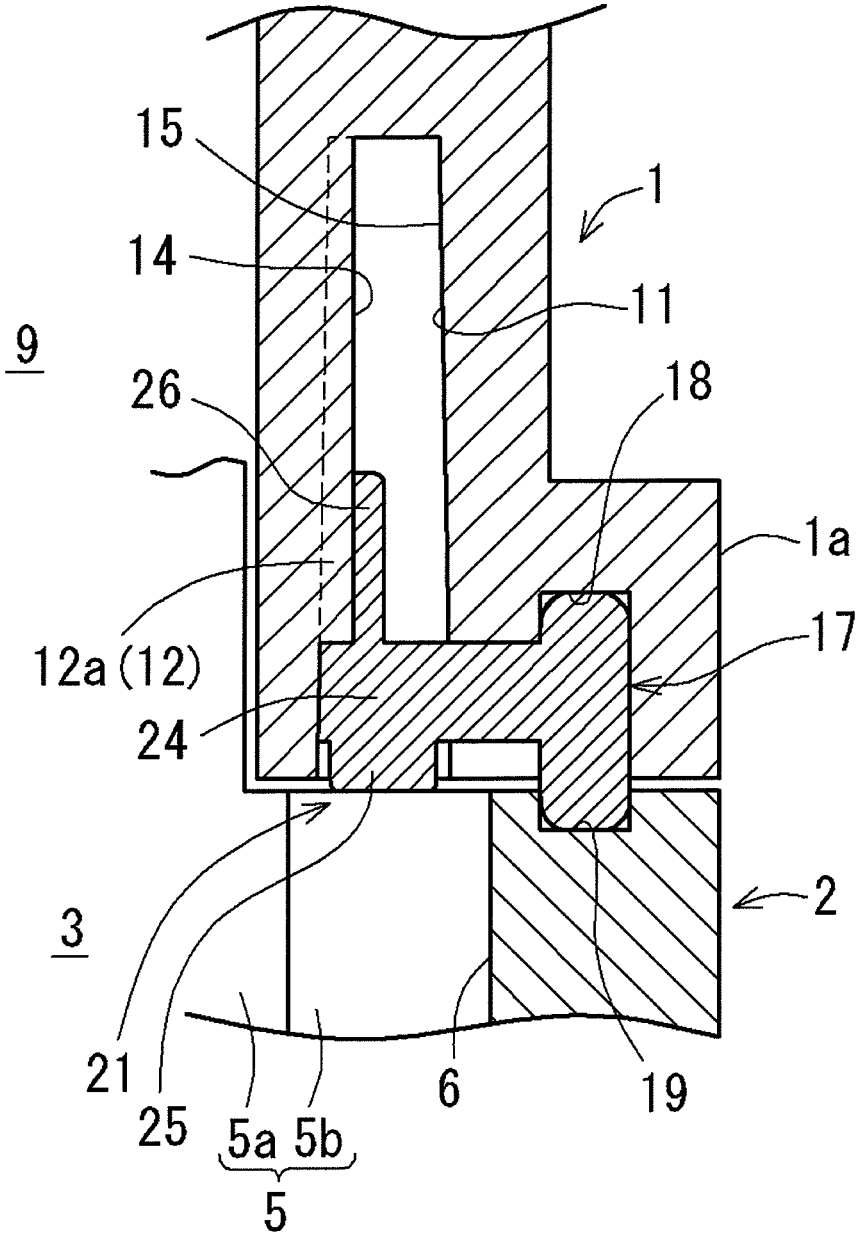
FIG. 2 is an enlarged sectional view taken along line II-II of FIG. 1.

A connection structure of an intake pipe according to the present embodiment is a connection structure of an intake pipe (1) for an engine head (2), the connection structure including a partition wall member (5) partitioning an intake passage (3) along its axial direction and being inserted into the engine head, and an elastic gasket (17) having a frame shape provided between the engine head and the intake pipe to seal therebetween, the intake pipe being provided at its connection end portion (1*a*) with an elastic body (21) that presses the partition wall member in its insertion direction (e.g., refer to FIGS. 1 and 2, etc.). The intake pipe is usually a pipe for feeding intake air to a combustion chamber of an engine.

Figure 4:
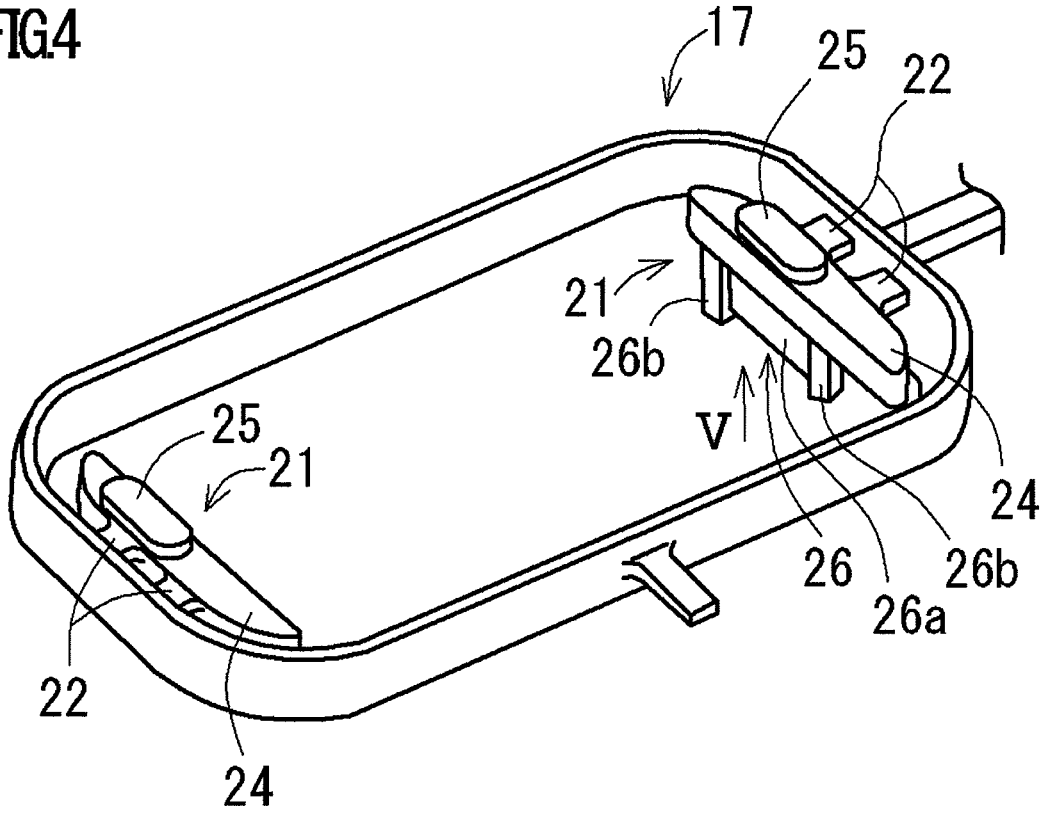
FIG. 4 is a perspective view of the elastic gasket.

Examples of the connection structure of the intake pipe according to the present embodiment include an embodiment in which the elastic body (21) is integrally formed inside the elastic gasket (17) (e.g., refer to FIG. 4, etc.).

Figure 3A:
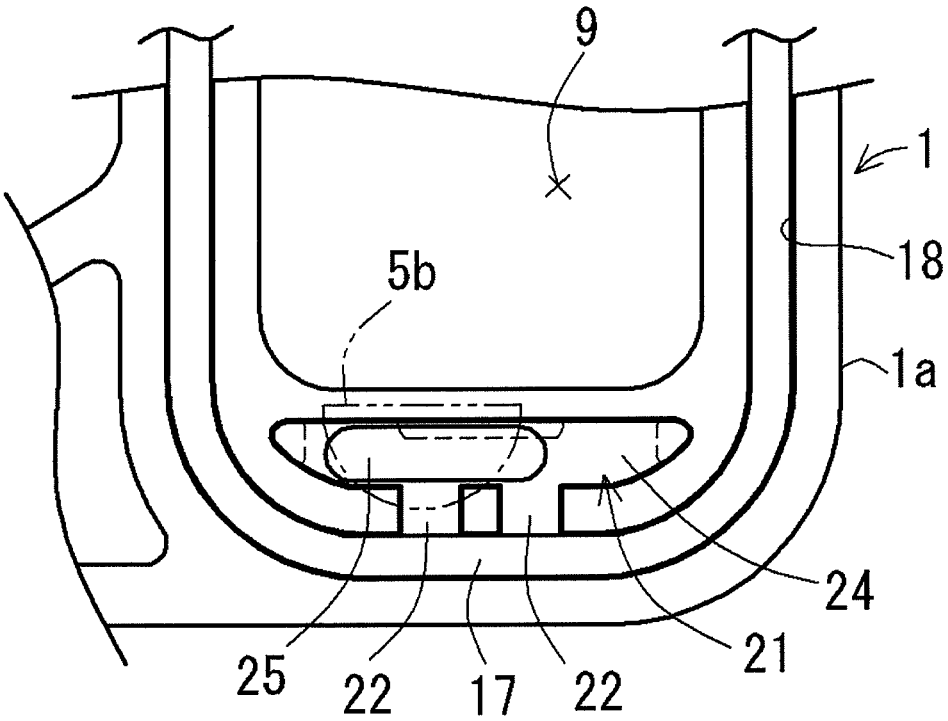
FIGS. 3A and 3B are each an enlarged sectional view taken along line III-III of FIG. 1, FIG. 3A illustrating a state where an elastic gasket is provided, and FIG. 3B illustrating a state where the elastic gasket is removed.
Figure 3B:
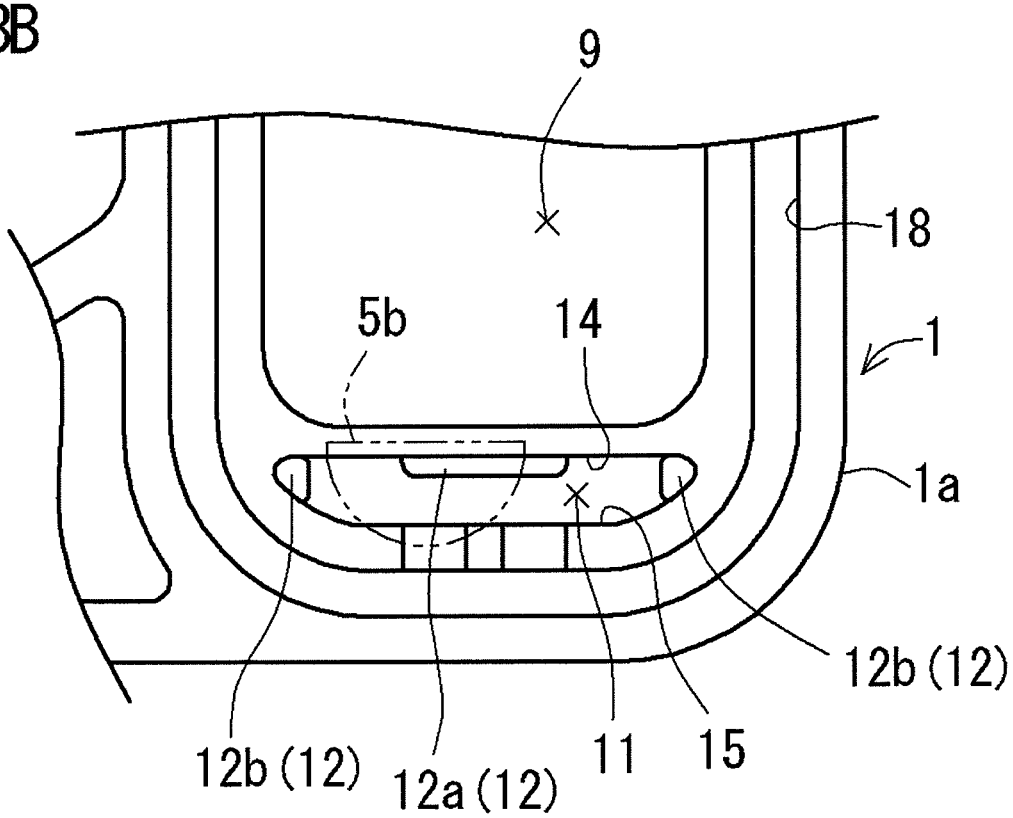

Examples of the connection structure of the intake pipe according to the present embodiment include an embodiment in which the intake pipe (1) is provided at its connection end portion (la) with a cutout portion (11) recessed in an axial direction of the intake pipe, and the cutout portion is provided in its inside wall with a stepped portion (12) for supporting a portion of the elastic body (21) on its insertion side to be inserted into the cutout portion (e.g., refer to FIGS. 2 and 3, etc.).

In the case of the above-described embodiment, the elastic body (21) may be formed in an elongated shape in plan view, and the stepped portion (12) may include a central stepped portion (12*a*) supporting a central portion of the elastic body in its elongated direction, and an end stepped portion (12*b*) supporting an end portion of the elastic body in its elongated direction, for example (e.g., refer to FIG. 3, etc.).

In the case of the above-described embodiment, the elastic body (21) may include a main body (24) inserted into the cutout portion (11) and supported by the stepped portion (12), a pressing portion (25) protruding from an end face of the main body toward the engine head (2) to press the partition wall member (5), and a contact portion (26) extending from the main body in its insertion direction to the cutout portion (11) to be brought into contact with a side surface of the stepped portion (12), for example (e.g., refer to FIGS. 2 and 4, etc.).

Examples of the connection structure of the intake pipe according to the present embodiment include an embodiment in which the partition wall member (5) includes a partition wall plate (5*a*) partitioning the intake passage (3), and insertion portions (5*b*) that are provided on both sides of the partition wall plate, and that are inserted into respective recessed portions (6) formed in an inside wall of the intake passage of the engine head (2) from the axial direction of the intake passage, and in which the elastic body (21) presses the insertion portion (6*b*) in its insertion direction, for example (e.g., refer to FIGS. 2 and 7, etc.).

The reference numeral in parentheses of each element described in the above embodiments indicates a correspondence with a specific element described in embodiments to be described below.

Embodiments

Hereinafter, the present invention will be described in detail using embodiments with reference to the drawings. In the present embodiment, an intake pipe 1 of an intake manifold connected to an intake passage 3 of an engine head 2 (also referred to as a "cylinder head") is exemplarily illustrated as an "intake pipe" according to the present invention (refer to FIG. 1).

(1) Connection Structure of Intake Pipe

In a connection structure of the intake pipe 1 according to the present embodiment, the engine head 2 has the intake passage 3 into which a partition wall member 5 for partitioning the intake passage 3 into two intake passages 3*a* and 3*b* along its axial direction is inserted from outside in the axial direction, as illustrated in FIG. 1. The partition wall member 5 includes a partition wall plate 5*a* made of metal for partitioning the intake passage 3, and a pair of insertion portions 5*b* and 5*b* that are provided on both sides of the partition wall plate 5*a*, and that are inserted into respective recessed portions 6 formed in an inside wall of the intake passage 3 of the engine head 2 from outside in the axial direction of the intake passage (refer to FIG. 7). The partition wall plate 5*a* extends from the intake passage 3 of the engine head 2 to an intake passage 9 of the intake pipe 1. Each of the insertion portions 5*b* has one end exposed to an end face of the engine head 2. The intake pipe 1 includes a valve 8 that is rotatably provided inside it to change a degree of opening of the one intake passage 3*a* partitioned by the partition wall member 5.

As illustrated in FIGS. 2 and 3, a pair of cutout portions 11 recessed in the axial direction of the intake pipe 1 is provided inside an elastic gasket 17 to be described below in a connection end portion 1*a* of the intake pipe 1. Each of the cutout portions 11 is arranged at a position corresponding to the respective insertion portions 5*b* of the partition wall member 5 inserted into the engine head 2. In other words, each of the cutout portions 11 is disposed at a position where a pressing portion 25 to be described below for pressing the insertion portion 5*b* can be inserted.

Each of the cutout portions 11 is provided in its inside wall with a stepped portion 12 that supports an insertion-side face of an elastic body 21, which will be described below, to be inserted into the respective cutout portions 11. The stepped portion 12 includes a central stepped portion 12*a* supporting a central portion of the elastic body 21 in its elongated direction, and a pair of end stepped portions 12*b* and 12*b* supporting an end portion of the elastic body 21 in its elongated direction. The stepped portions 12*a* and 12*b* are provided in an inner wall 14 close to the axis of the intake pipe 1, which is a part of an inside wall of the cutout portion 11, but are not provided in an outer wall 15 facing the inner wall. The stepped portions 12*a* and 12*b* each have a lower end extending to a bottom surface of each of the cutout portions 11. The intake pipe 1 above has the connection end portion 1*a* formed in the shape of a flange (refer to FIG. 1).

Between the engine head 2 and the intake pipe 1, there is provided the elastic gasket 17 having a frame shape and made of rubber (or made of elastomer) for sealing between the engine head 2 and the intake pipe 1 (refer to FIG. 4) as illustrated in FIGS. 1 to 3. The elastic gasket 17 is disposed so as to surround the partition wall member 5. The elastic gasket 17 is mounted in mounting grooves 18 and 19 formed in the connection end portions of the intake pipe 1 and the engine head 2, respectively. The elastic gasket 17 is integrally formed of a plurality of elastic gaskets corresponding to the number of cylinders of the engine.

Figure 5:
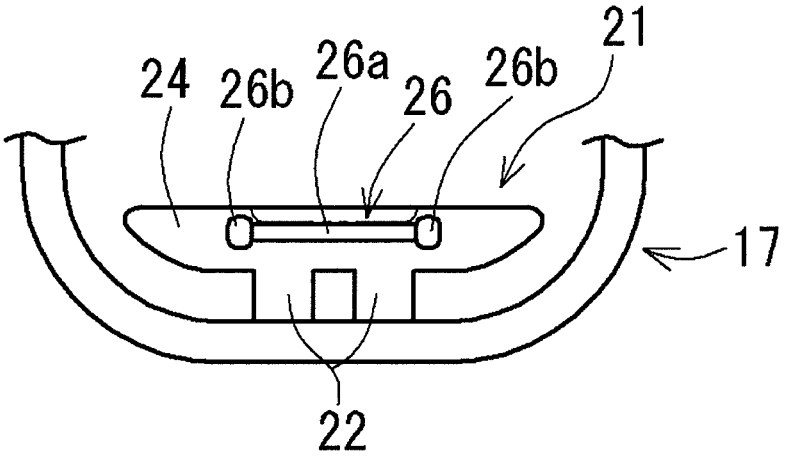
FIG. 5 is an enlarged view of a main part as viewed in the direction of arrow V of FIG. 4.
Figure 6:
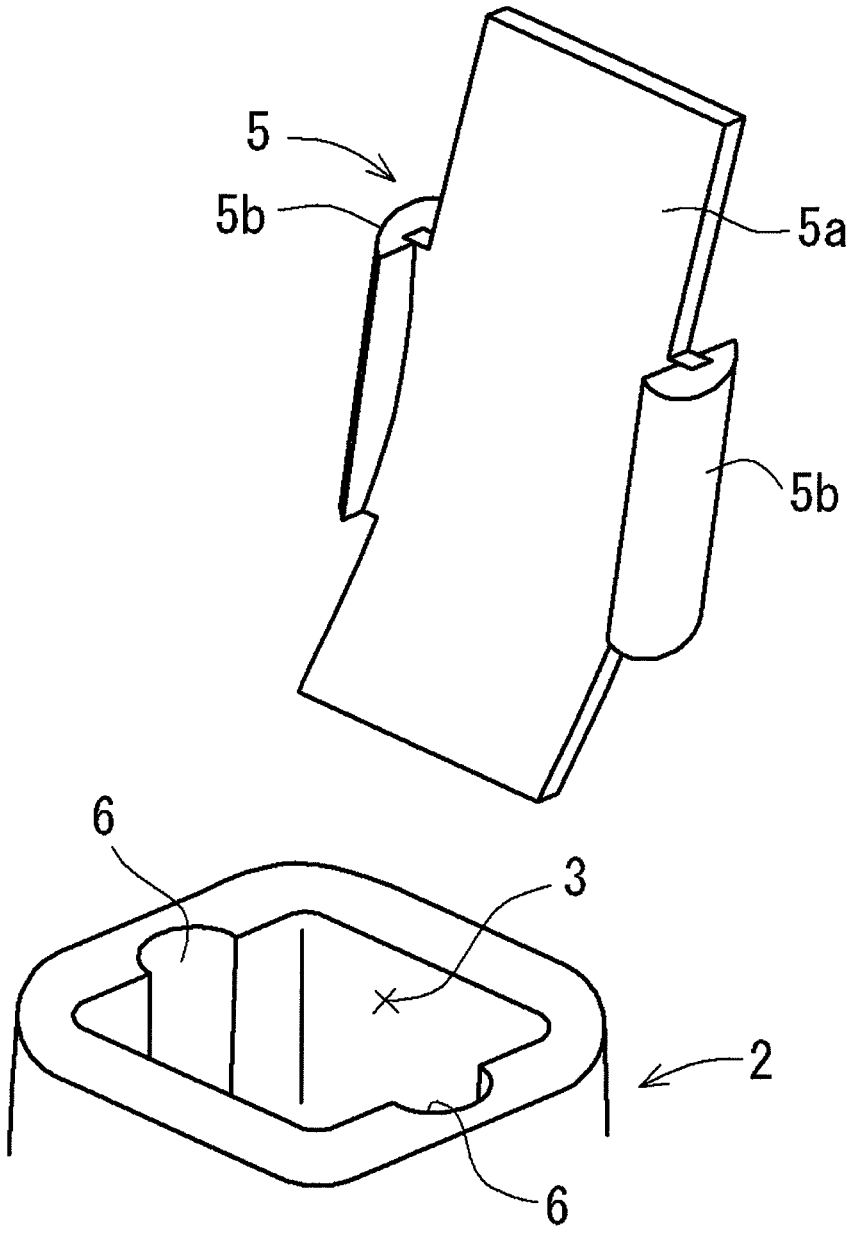
FIG. 6 is a perspective view of a partition wall member according to an embodiment.

As illustrated in FIGS. 2 to 4, the elastic body 21 for pressing the insertion portion 5*b* of the partition wall member 5 in the insertion direction is provided inside the elastic gasket 17 in the connection end portion 1*a* of the intake pipe 1. The elastic body 21 is integrally formed with the elastic gasket 17 on its inner circumferential side with connecting portions 22 provided therebetween. The elastic body 21 is formed in an elongated shape in plan view. The elastic body 21 includes a main body 24 inserted into the cutout portion 11 and supported by each of the stepped portions 12*a* and 12*b*, a pressing portion 25 protruding from an end face of the main body 24, facing the engine head 2, to press the insertion portion 5*b* of the partition wall member 5, and a contact portion 26 extending from the main body 24 in its insertion direction to the cutout portion 11 to be brought into contact with a side surface of the central stepped portion 12*a*. The main body 24 is formed in a shape that can be press-fitted into the cutout portion 11. The contact portion 26 includes a contact plate 26*a* that is brought into contact with a side surface of the central stepped portion 12*a*, and a pair of pillars 26*b* and 26*b* provided on both sides of the contact plate 26*a* and holding the central stepped portion 12*a* laterally (refer to FIG. 5).

(2) Action of Connection Structure of Intake Pipe

Next, action of the connection structure of the intake pipe 1 having the above configuration will be described. As illustrated in FIG. 1, when an degree of opening of the one intake passage 3*a* is maximized by the valve 8 in an open state (indicated by an imaginary line in the drawing), intake air flowing through the intake pipe 1 flows through each of the intake passages 3*a* and 3*b* to be fed to the combustion chamber of the engine. Meanwhile, when the degree of opening of the one intake passage 3*a* is minimized by the valve 8 in a closed state (indicated by a solid line in the drawing), the intake air flowing through the intake pipe 1 hardly flows through the one intake passage 3*a* and flows through the other intake passage 3*b* to be fed to the combustion chamber of the engine. Then, the intake air at an increased flow rate is fed into the combustion chamber, so that a tumble flow is generated to achieve rapid combustion of fuel therein.

The connection structure of the intake pipe 1 is configured such that while a space between the engine head 2 and the intake pipe 1 is sealed by the elastic gasket 17, the elastic body 21, using its surface pressure, presses the pair of insertion portions 5*b* and 5*b* of the partition wall member 5 in their insertion direction (or, in a downstream direction of the flow of the intake air). This suppresses sliding (vibrating) of the insertion portions 5*b* in the respective recessed portions 6 due to pulsation of the engine.

(3) Effect of Embodiments

The connection structure of the intake pipe 1 of the present embodiment is configured such that the partition wall member 5 that partitions the intake passage 3 along its axial direction is inserted in the engine head 2, and the elastic gasket 17 having a frame shape is provided between the engine head 2 and the intake pipe 1 to seal therebetween, and such that the elastic body 21 is provided in the connection end portion 1*a* of the intake pipe 1 to press the partition wall member 5 in its insertion direction. Accordingly, the elastic body 21 presses the partition wall member 5 in the insertion direction, so that sliding of the partition wall member 5 against the engine head 2 due to pulsation of the engine is suppressed.

The present embodiment is configured such that the elastic body 21 is integrally formed inside the elastic gasket 17. This enables the elastic body 21 and the elastic gasket 17 to be easily handled as an integrated body.

In addition, the present example is configured such that the intake pipe 1 is provided at its connection end portion 1*a* with the cutout portion 11, and the cutout portion 11 is provided in its inside wall with the stepped portion 12 for supporting a portion of the elastic body 21 on its insertion side to be inserted into the cutout portion 11. As a result, displacement (or falling down) of the portion of the elastic body 21 on its insertion side into the cutout portion 11 is restricted by the support of the stepped portion 12. This enables not only a support structure of the elastic body 21 to be set using the cutout portion 11, but also the cutout portion 11 to prevent the intake pipe 1 from increasing in thickness to suppress defective molding and increase in cycle time.

The present embodiment is configured such that the elastic body 21 is formed in an elongated shape in plan view, and the stepped portion 12 includes the central stepped portion 12*a* and the end stepped portion 12*b*. As a result, the central stepped portion 12*a* supports a central portion of the elastic body 21 in its elongated direction, and the end stepped portion 12*b* supports an end portion of the elastic body 21 in its elongated direction. This allows the stepped portion 12 to stably support the elastic body 21 even when the elastic body 21 deteriorates over time. As a result, the elastic body 21 can effectively press the partition wall member 5 for a long period.

In addition, the present embodiment is configured such that the elastic body 21 includes the main body 24, the pressing portion 25, and the contact portion 26. As a result, the pressing portion 25 presses the partition wall member 5 in its insertion direction with the contact portion 26 in contact with a side surface of the stepped portion 12 supporting the main body 24. This allows the stepped portion 12 to stably support the elastic body 21 even when the elastic body 21 deteriorates over time. As a result, the elastic body 21 can effectively press the partition wall member 5 for a long period.

Figure 7A:
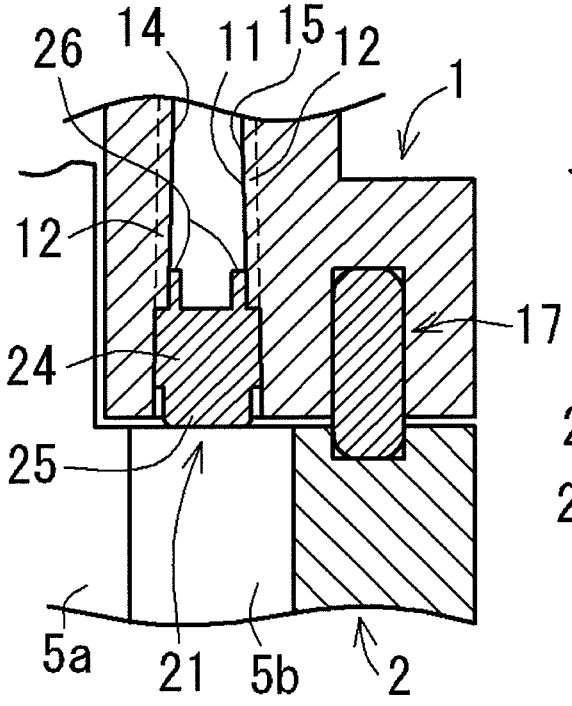
FIGS. 7A and 7B each illustrate a connection structure of an intake pipe according to other embodiments, FIG. 7A illustrating another embodiment including an elastic body separated from an elastic gasket, and FIG. 7B illustrating still another embodiment in which an intake pipe includes no cutout portion.

The present invention is not limited to the embodiments described above, and can be variously modified within the scope of the present invention depending on purpose and use. That is, while the embodiment described above exemplarily shows the elastic body 21 that is integrally provided inside the elastic gasket 17, the present invention is not limited thereto. For example, the elastic body 21 may be provided separately from the elastic gasket 17 as illustrated in FIG. 7A.

Figure 7B:
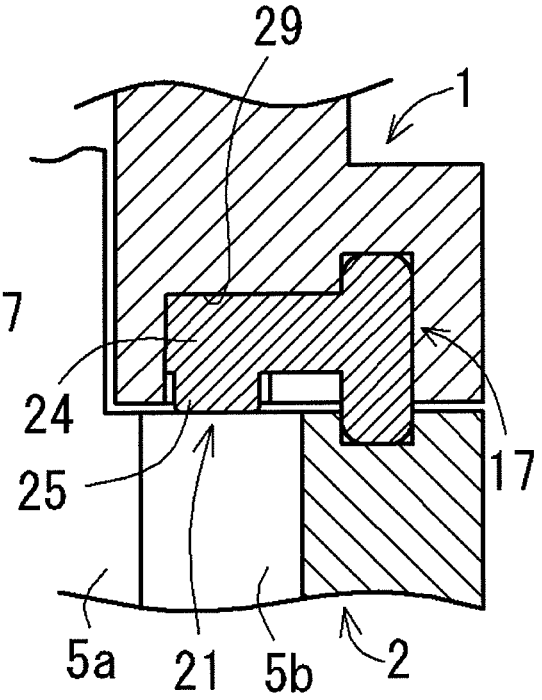

In addition, while the embodiment described above is configured such that the support structure (or the stepped portion 12) of the elastic body 21 is set using the cutout portion 11, the present invention is not limited thereto. For example, the connection end portion 1*a* of the intake pipe 1 may be provided with a recessed portion 29 for supporting a bottom portion of the elastic body 21 without providing the cutout portion 11 as illustrated in FIG. 7B.

Figure 8:
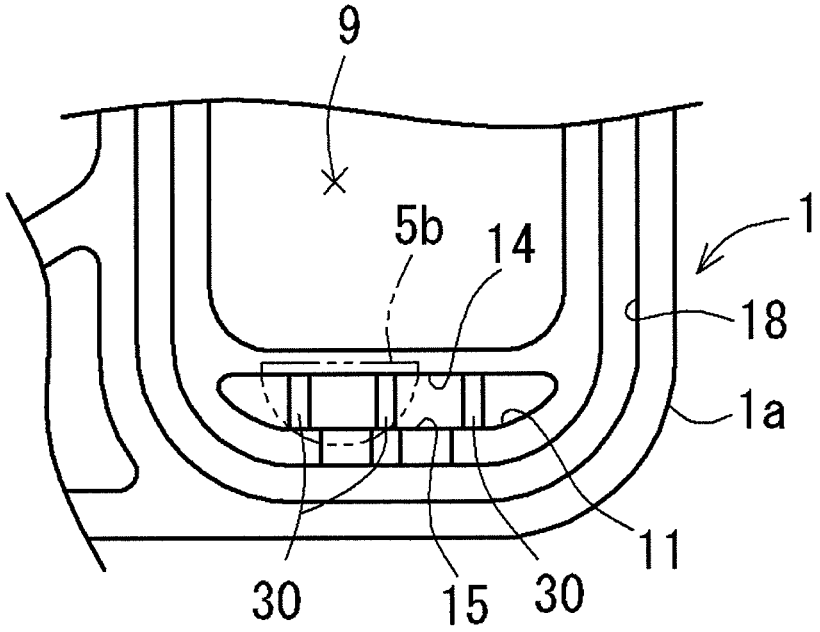
FIG. 8 illustrates a connection structure of an intake pipe according to still another embodiment.

Further, while the embodiment described above exemplarily shows the stepped portion 12 that is provided in the inner wall 14 of the cutout portion 11, the present invention is not limited thereto. For example, the stepped portion 12 may be provided in each of the inner wall 14 and the outer wall 15 of the cutout portion 11 as illustrated in FIG. 7A. In addition, as illustrated in FIG. 8, stepped ribs 30 connected between the inner wall 14 and the outer wall 15 of the cutout portion 11 may be used, for example.

It is noted that the foregoing examples have been provided merely for the purpose of explanation and are in no way to be construed as limiting of the present invention. While the present invention has been described with reference to exemplary embodiments, it is understood that the words which have been used herein are words of description and illustration, rather than words of limitation. Changes may be made, within the purview of the appended claims, as presently stated and as amended, without departing from the scope and spirit of the present invention in its aspects. Although the present invention has been described herein with reference to particular structures, materials and embodiments, the present invention is not intended to be limited to the particulars disclosed herein; rather, the present invention extends to all functionally equivalent structures, methods and uses, such as are within the scope of the appended claims.

The present invention is not limited to the above-described embodiments, and various variations and modifications may be possible without departing from the scope of the present invention.

The present invention is widely used as a technique related to a connection structure of an intake pipe for an engine head used in vehicles such as passenger cars, buses, and trucks.

What is claimed is:

1. A connection structure of an intake pipe for an engine head, comprising: a partition wall member partitioning an intake passage along an axial direction of the intake passage and being inserted into the engine head; and an elastic gasket having a frame shape provided between the engine head and the intake pipe to seal there between, wherein the intake pipe is provided at a connection end portion of the intake pipe with an elastic body that presses the partition wall member in an insertion direction of the partition wall member.

2. The connection structure of the intake pipe, according to claim 1, wherein the elastic body is integrally formed inside the elastic gasket.

3. The connection structure of the intake pipe, according to claim 1, wherein the intake pipe is provided at the connection end portion with a cutout portion recessed in an axial direction of the intake pipe, and the cutout portion is provided in an inside wall with a stepped portion supporting a portion of the elastic body on an insertion side of the elastic body to be inserted into the cutout portion.

4. The connection structure of the intake pipe, according to claim 2, wherein the intake pipe is provided at the connection end portion with a cutout portion recessed in an axial direction of the intake pipe, and the cutout portion is provided in an inside wall with a stepped portion supporting a portion of the elastic body on an insertion side of the elastic body to be inserted into the cutout portion.

5. The connection structure of the intake pipe, according to claim 3, wherein the elastic body is formed in an elongated shape in plan view, and the stepped portion includes a central stepped portion supporting a central portion of the elastic body in an elongated direction, and an end stepped portion supporting an end portion of the elastic body in an elongated direction.

6. The connection structure of the intake pipe, according to claim 3, wherein the elastic body includes:

a main body inserted into the cutout portion and supported by the stepped portion;

a pressing portion protruding from an end face of the main body, facing the engine head, to press the partition wall member; and a contact portion extending from the main body in an insertion direction to the cutout portion to be brought into contact with a side surface of the stepped portion.

7. The connection structure of the intake pipe, according to claim 6, wherein the contact portion includes a contact plate that is brought into contact with a side surface of the stepped portion, and a pair of pillars provided on both sides of the contact plate to hold the stepped portion laterally.

8. The connection structure of the intake pipe, according to claim 1, wherein the partition wall member includes a partition wall plate partitioning the intake passage, and insertion portions that are provided on both sides of the partition wall plate, and that are inserted into respective recessed portions formed in an inside wall of the intake passage of the engine head from an axial direction of the intake passage, and the elastic body is provided so as to press the insertion portion in an insertion direction.

* * * * *